US006415687B2

(12) United States Patent
Saxman

(10) Patent No.: US 6,415,687 B2
(45) Date of Patent: Jul. 9, 2002

(54) ROTARY CONE DRILL BIT WITH MACHINED CUTTING STRUCTURE AND METHOD

(75) Inventor: William C. Saxman, Dallas, TX (US)

(73) Assignee: Dresser Industries, Inc., Dallas, TX (US)

( * ) Notice: Subject to any disclaimer, the term of this patent is extended or adjusted under 35 U.S.C. 154(b) by 0 days.

(21) Appl. No.: 09/776,519

(22) Filed: Feb. 2, 2001

Related U.S. Application Data

(63) Continuation of application No. 09/114,787, filed on Jul. 13, 1998, now Pat. No. 6,206,116.

(51) Int. Cl.[7] ..... B21K 5/04
(52) U.S. Cl. ..... 76/108.2; 76/108.1; 175/378
(58) Field of Search ..... 76/108.1, 108.2; 175/331, 341, 375, 377, 378; D15/132, 139

(56) References Cited

U.S. PATENT DOCUMENTS

| | | | | | |
|---|---|---|---|---|---|
| 2,660,405 | A | * | 11/1953 | Scott et al. | 76/108.1 |
| 2,669,432 | A | * | 2/1954 | Dill et al. | 175/375 |
| 2,939,684 | A | * | 6/1960 | Payne | 175/375 |
| 3,266,342 | A | * | 8/1966 | Coulter, Jr. et al. | 76/108.1 |
| 4,726,432 | A | * | 2/1988 | Scott et al. | 175/375 |
| 6,206,116 | B1 | * | 3/2001 | Saxman | 175/378 |

* cited by examiner

*Primary Examiner*—Hwei-Siu Payer

(57) ABSTRACT

A rotary cone drill bit is provided with at least one cutter cone assembly having a machined cutting structure which will maintain an effective cutting profile despite abrasion, erosion and/or wear of the associated cutting elements. The machined cutting structure may be formed on a generally cone shaped blank by a series of lathe turns and/or plunge cuts. The cutting elements may be formed with an aggressive cutting profile. For one application, the crest of each cutting element has the general configuration of an ogee curve. A layer of hardfacing material may be applied over all or selected portions of the machined cutting structure.

14 Claims, 4 Drawing Sheets

100a
100b
90
102
104
106
110
111
112
113
116
118
120
121
122
126
127
127a
128
128a
129
129a
137
137a
138
138a
141
142
143
146
148
150
152
154

ROTARY CONE DRILL BIT WITH MACHINED CUTTING STRUCTURE AND METHOD

This application is a continuation of Ser. No. 09/114,787, filed Jul. 13, 1998, now U.S. Pat. No. 6,206,116.

TECHNICAL FIELD OF THE INVENTION

This invention relates generally to rotary cone drill bits and, more particularly, to a rotary cone drill bit having at least one cutter cone assembly with a machined cutting structure and method of forming the cutting structure.

BACKGROUND OF THE INVENTION

A wide variety of rotary cone drill bits are used for drilling earth boreholes for the exploration and production of oil and gas and for mining operations. Such drill bits often employ multiple rolling cutter cone assemblies, also known as rotary cutter cone assemblies. The cutter cone assemblies are typically mounted on respective spindles or journals that extend downwardly and inwardly relative to an axis extending through an associated bit body so that conical surfaces of the cutter cone assemblies tend to roll on the bottom of a borehole in contact with the adjacent earth formation. Cutter cone assemblies generally have circumferential rows of milled teeth or inserts to scrape, cut and/or gouge the formation at the bottom of the borehole. Forming teeth on a generally conically shaped forging by milling is often a relatively expensive, time consuming process. Multiple milling steps are frequently required to form each tooth of a typical milled teeth cutting structure.

Milled teeth on conventional cone assemblies tend to wear in those areas that engage the bottom and side wall of a borehole during drilling operations. Milled teeth typically have a generally pyramidal configuration with a trapezoidal cross-section extending from the exterior surface of the associated cutter cone assembly. The generally pyramidal configuration is formed during the milling operation to provide sufficient structural support with adjacent portions of the associated cutter cone assembly. As a result of slanted surfaces associated with the generally pyramidal, milled teeth will generally become more blunt from abrasion, erosion and wear during drilling operations. Unless additional weight is applied to the associated rotary cone drill bit, the penetration rate will generally decrease as the area of contact increases with the bottom of a borehole resulting from the wear of milled teeth having a generally pyramidal configuration.

The service life of a rotary cone drill bit having cutter cone assemblies with respective milled teeth cutting structures may be improved by the addition of abrasion and wear resistant materials to selected wear areas of each tooth. The addition of abrasion and wear resistant materials to milled teeth is sometimes referred to as "hardfacing." In a hardfacing operation, abrasion and wear resistant material is applied to the teeth to provide not only a wear resistant surface to reduce the rate at which each milled tooth is worn off, but also to maintain sharper cutting edges as the teeth wear.

Examples of rotary cone drill bits having cutter cone assemblies with respective milled teeth cutting structures are shown in U.S. Pat. No. 5,579,856 entitled *Gage Surface and Method for Milled Tooth Cutting Structure* and U.S. Pat. No. 2,533,256 entitled *Drill Cutter.* Such drill bits may sometimes be referred to as "steel tooth" drill bits or "milled tooth" drill bits.

Conventional cutter cone assemblies with milled teeth often include multiple rows of teeth disposed on the respective conical surfaces. Such cutter cone assemblies somewhat resemble spur gears or bevel gears with interlocking or intermeshing teeth. Variations of these patterns include skewing the teeth similar to that of a spiral bevel gear, or even an alternating skew to produce a herringbone effect. Another accepted version of a drill bit is an interrupted circumferential disc having a resulting appearance of teeth aligned end to end around the periphery of the associated cutter cone assembly.

SUMMARY OF THE INVENTION

In accordance with teachings of the present invention, disadvantages and problems associated with previous rotary cone bits having multiple cutter cone assemblies with milled teeth cutting structures have been substantially reduced or eliminated. One aspect of the present invention includes providing a rotary cone drill bit having at least one cutter cone assembly with a machined cutting structure formed by a series of lathe turns and/or plunge cuts. The desired machined cutting structure may be integrally formed on a forging or casting have a generally conical configuration associated with cutter cone assemblies.

For one application, the machined cutting structure may be described as a series of corrugated webs having a generally sinusoidal configuration. Each corrugated web preferably extends circumferentially around the conical surface of an associated cutter cone assembly. The corrugated webs on each cutter cone assembly are spaced a selected distance from each other to provide an intermeshing or overlapping relationship with corresponding corrugated webs found on adjacent cutter cone assemblies. Depending upon anticipated downhole drilling conditions, the machined cutting structure may be heat treated or covered with a layer of hardfacing material using presently available techniques and materials or any future techniques and materials developed for rotary cone drill bits.

For another application, the machine cutting structure may be described as a series of interrupted webs formed by cutting or machining a generally continuous corrugated web into individual cutting elements extending from the exterior surface of an associated cutter cone assembly. The interrupted webs on each cutter cone assembly and respective individual cutting elements of each interrupted web are preferably spaced a selected distance from each other to provide an intermeshing or overlapping relationship with corresponding interrupted webs and cutting elements formed on adjacent cutter cone assemblies. The present invention allows optimizing the resulting machined cutting structure to provide substantially enhanced downhole drilling action.

Technical advantages of the present invention include the ability to use a wide variety of metal shaping and/or machining operations to form a cutting structure on the exterior of a cutter cone assembly with aggressive cutting element profiles. As cutter cone assemblies with selected machined cutting structures are rolled over the bottom of a borehole, each cutting element will preferably first attack the downhole formation with a slicing type effect, then translate into a crosscut and plowing type effect. This combination of drilling actions will enhance penetration rates, as well as improved bottom hole cleaning. Machined cutting structures may be formed on cutter cone assemblies in accordance with teachings of the present invention to provide for more favorable drill bit geometry to improve directional drilling control. The resulting machined cutting structures provide increased circumferential surface engagement with the formation at the bottom of a borehole which improves dynamic stability and reduces gauge wear without any reduction in downhole drilling efficiency.

Many different lathe turning steps, plunge cutting steps and/or other metal machining techniques may be used in accordance with teachings of the present invention to form machined cutting structures with a wide variety of geometric configurations and selected cutting profiles for each cutting element. The present invention is not limited to any specific sequence of machining operations, cutting element profiles, corrugated web configuration and/or interrupted web configurations. The present invention also allows using a wide variety of metals, metal alloys and other materials to form each cutter cone assembly.

Further, technical advantages of the present invention include providing a rotary cone drill bit with at least two and preferably three cutter cone assemblies having machined cutting structures. The geometric configuration and cutting profile of each cutting element may be optimized to improve overall downhole drilling efficiency of the associated drill bit. Each cutting element is preferably formed with a generally uniform thickness and steep sides extending generally perpendicular from the exterior surface of an associated cutter assembly. The cutting profile of each cutting element will remain relatively sharp despite substantial abrasion and wear of the associated cutting element. An aggressive cutting profile may be formed on each cutting element to allow increasing the penetration rate of the associated drill bit, while at the same time extending downhole service life since the cutting elements will remain relatively sharp despite abrasion and wear. Cutter cone assemblies having machined cutting structures formed in accordance with teachings of the present invention may be used with rotary cone drill bits, core bits, hole openers, and other types of earth boring equipment.

BRIEF DESCRIPTION OF THE DRAWINGS

For a more complete understanding of the present invention, and the advantages thereof, reference is now made to the following description taken in conjunction with the accompanying drawings in which like reference numbers indicate like features, and wherein.

DETAILED DESCRIPTION OF THE INVENTION

Figure 1:
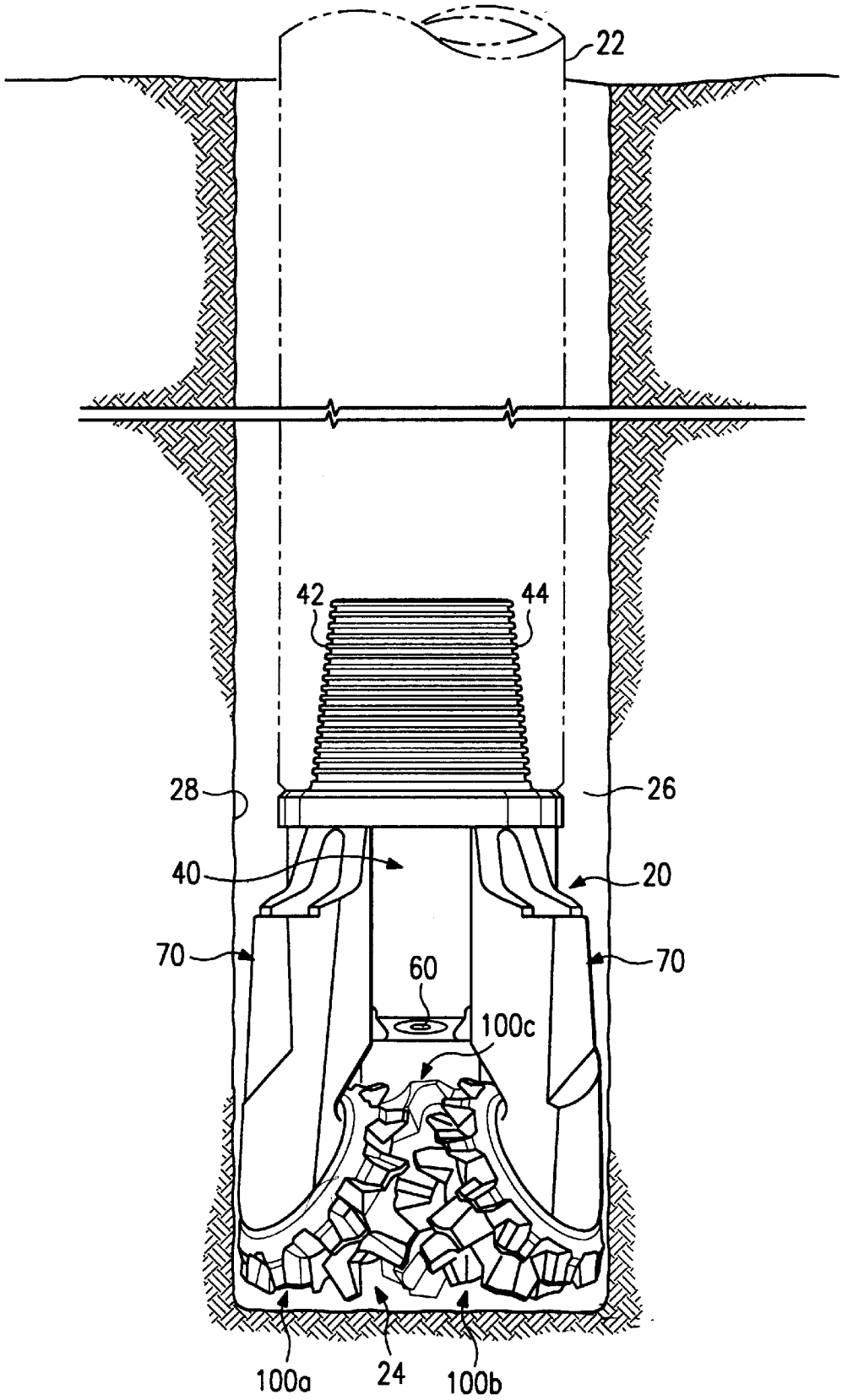
FIG. 1 is a schematic drawing in elevation and in section with portions broken away of a rotary cone drill bit, incorporating teachings of the present invention, attached to one end of a drill string disposed in a borehole.

Embodiments of the present invention and its advantages are best understood by referring to FIGS. 1 through 7 of the drawings, like numerals being used for like and corresponding parts of the various drawings.

For purposes of illustration, the present invention is shown embodied in rotary cone drill bit 20 of the type used to drill a borehole in the earth. Rotary cone drill bit 20 may sometimes be referred to as a "rotary drill bit" or "rock bit." Rotary cone drill bit 20 preferably includes threaded connection or pin 44 for use in attaching drill bit 20 with drill string 22. Threaded connection 44 and a corresponding threaded connection (not expressly shown) associated with drill string 22 are designed to allow rotation of drill bit 20 in response to rotation of drill string 22 at the well surface.

In FIG. 1, drill bit 20 is shown attached to drill string 22 and disposed in borehole 24. Annulus 26 is formed between the exterior of drill string 22 and the interior or wall 28 of borehole 24. In addition to rotating drill bit 20, drill string 22 is often used as a conduit for communicating drilling fluids and other fluids from the well surface to drill bit 20 at the bottom of borehole 24. Such drilling fluids may be directed to flow from drill string 22 to nozzles 60 provided in drill bit 20. Cuttings formed by drill bit 20 and any other debris at the bottom of borehole 24 will mix with drilling fluids exiting from nozzles 60 and return to the well surface via annulus 26.

For rotary cone drill bit 20 cutting or drilling action occurs as cutter cone assemblies 100*a*, 100*b* and 100*c* are rolled around the bottom of borehole 24 by rotation of drill string 22. Cutter cone assemblies 100*a*, 100*b* and 100*c* have substantially the same general configuration and overall dimensions except for machined cutting structures 110, 120 and 130 respectively formed on the exterior surface of cutter cone assemblies 100*a*, 100*b* and 100*c* in accordance with teachings of the present invention. Cutter cone assemblies 100*a*, 100*b* and 100*c* may sometimes be referred to as "rotary cone cutters" or "roller cone cutters." The inside diameter of borehole 24 defined by wall 28 corresponds approximately with the combined outside diameter or gage diameter of cutter cone assemblies 100*a*, 100*b* and 100*c*. See FIG. 3.

Machined cutting structures 110, 120 and 130 scrape, cut, gouge, slice, plow and/or chisel the sides and bottom of borehole 24 in response to weight and rotation applied to drill bit 20 from drill string 22. Machined cutting structures 110, 120 and 130 may be varied in accordance with teachings of the present invention to provide the desired type of downhole drilling action appropriate for the anticipated downhole formation.

Figure 3:
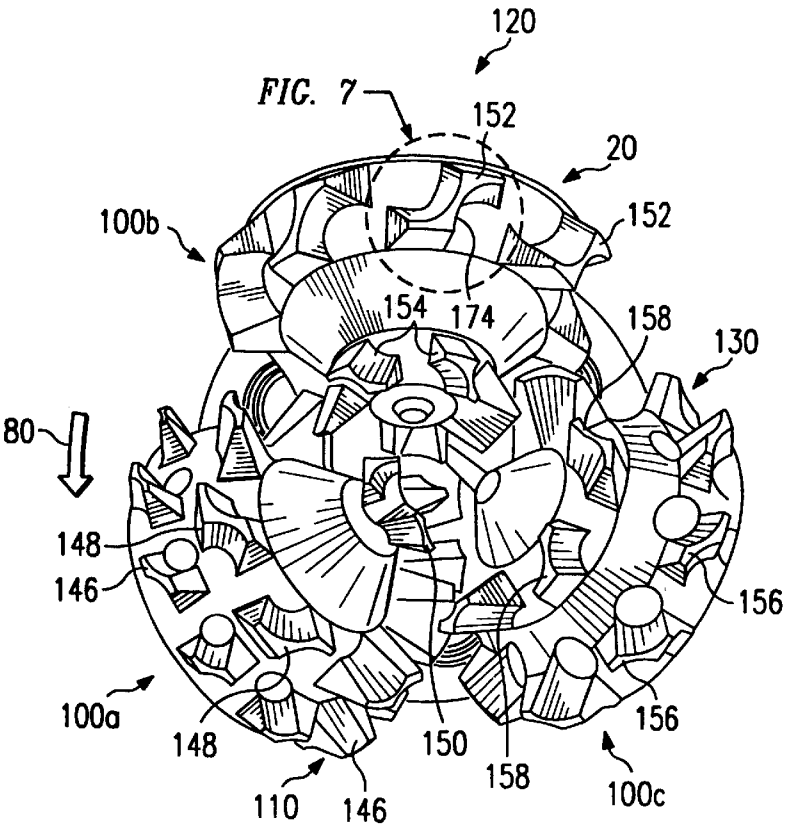
FIG. 3 is an end view of the rotary cone drill bit of FIG. 2.
Figure 2:
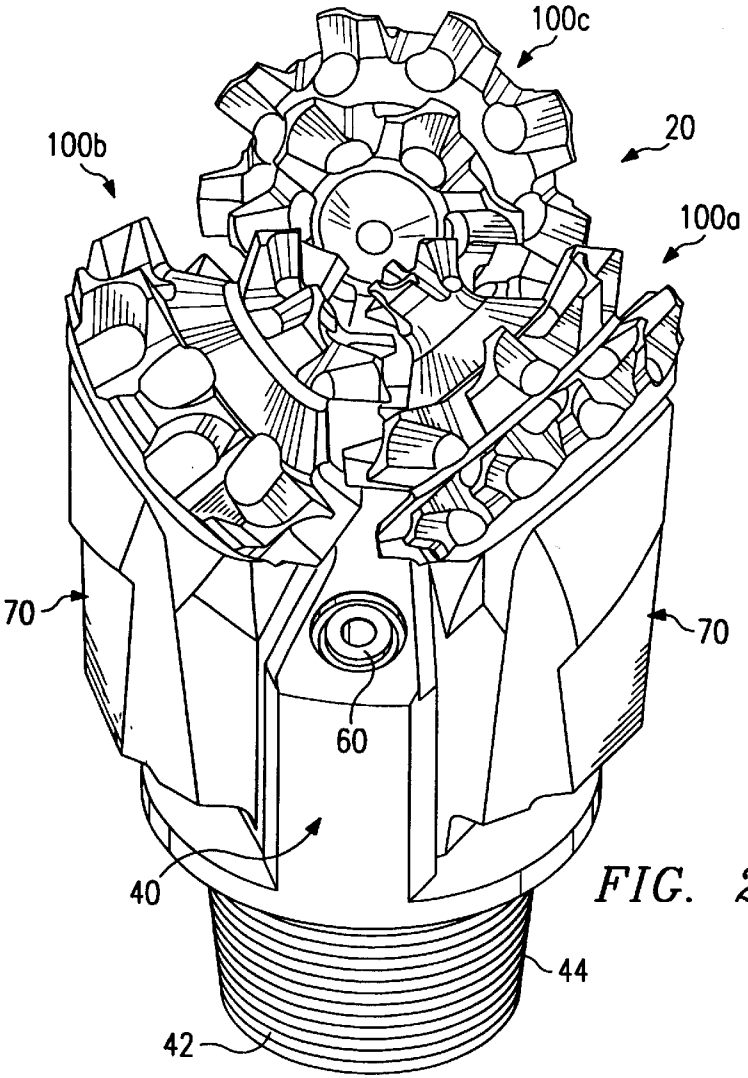
FIG. 2 is a schematic drawing showing an isometric view of the rotary cone drill bit of FIG. 1.

Drill bit 20 shown in FIGS. 1, 2 and 3 comprises a one piece or unitary bit body 40 with upper portion 42 having threaded connection or pin 44 adapted thereto to secure drill bit 20 to the lower end of drill string 22. Three support arms 70 are preferably attached to and extend longitudinally from bit body 40 opposite from pin 44. Each support arm 70 preferably includes a spindle (not expressly shown) connected to and extending from an inside surface (not expressly shown) of the respective support arm 70. Examples of such drill bits and their associated bit body, support arms and cutter cone assemblies are shown in U.S. Pat. No. 5,439,067 entitled *Rock Bit With Enchanted Fluid Return Area* and U.S. Pat. No. 5,439,068 entitled *Modular Rotary Drill Bit.*

U.S. Pat. No. 4,056,153 entitled *Rotary Rock Bit With Multiple Row Coverage For Very Hard Formations* and U.S. Pat. No. 4,280,571 entitled *Rock Bit,* show other examples of conventional rotary cone drill bits with cutter cone assemblies mounted on a spindle projecting from a support arm. These patents provide additional information concerning the manufacture and assembly of bit bodies, support arms and cutter cone assemblies which are satisfactory for use with the present invention. A cutter cone assembly having a machined cutting structure formed in accordance with teachings of the present invention may be used on a wide variety of drill bits and other downhole tools. The present invention is not limited to use with drill bit 20 or cutter cone assemblies 100*a*, 100*b*, and 100*c*.

FIG. 3 shows a bottom plan view of drill bit 20. Arrow 80 indicates the preferred direction for rotation of drill bit 20. Each cutter cone assembly 100*a*, 100*b* and 100*c* includes respective base portion 102 having a generally flat circular configuration with nose 106 disposed opposite therefrom. Base portion 102 preferably includes an opening (not expressly shown) and a cavity (not expressly shown) extending therefrom to allow mounting cutter cone assemblies 100*a*, 100*b* and 100*c* on respective spindles (not expressly shown). Generally tapered, conical surface 104 extends from each base portion 102 and terminates at respective nose 106.

Machined cutting structures 110, 120 and 130 are formed on generally tapered, conical surface or exterior surfaces 104 of respective cutter cone assemblies 100*a*, 100*b* and 100*c*. First machined cutting structure 110 includes three rows 111, 112 and 113 of cutting elements designated respectively as 146, 148 and 150. Row 111 is formed immediately adjacent to associated base portion 102 and extends circumferentially around conical surface 104. A row 113 is formed adjacent to nose 106. Row 112 extends circumferentially around conical surface 104 spaced from first row 111 and third row 113. See FIG. 4C.

Second machined cutting structure 120 includes two rows 121 and 122 of cutting elements designated respectively as 152 and 154. Row 121 is formed immediately adjacent to associated base portion 102 and extends circumferentially around conical surface 104. Second row 122 extends circumferentially around conical surface 104 spaced from first row 121 and associated nose 106. See FIG. 5C.

Third machined cutting structure 130 includes two rows 131 and 132 of cutting elements designated as 156 and 158. Row 131 is formed immediately adjacent to the associated base portion 102 and extends circumferentially around conical surface 104. Second row 132 of cutting elements extends circumferentially around conical surface 104 spaced from first row 131 and associated nose 106. See FIG. 6C.

One of the benefits of the present invention includes the ability to select the location and configuration of each row of cutting elements and the size, configuration and orientation of each cutting element in each row to optimize downhole drilling performance of the associated rotary cone drill bit. For example, the location and configuration of first row 111, second row 112 and third row 113 formed on the exterior of cutter cone assembly 100*a* are selected to interfit and/or overlap with first row 121, second row 122 and third row of cutting elements formed on the exterior of cutter cone assembly 100*b*. In a similar manner first row 131, second 132 and third row formed on the exterior of cutter cone assembly 100*c* are selected to overlap and interfit with first machined cutting structure 110 and second machined cutting structure 120.

The size, configuration and orientation of cutting elements 146, in first row 111 of first machined cutting structure 110, cutting elements 152 in first row 121 of second machined cutting structure 120 and cutting elements 156 in first row 131 of third machined cutting structure 130 are preferably selected to provide overlapping contact with the bottom of borehole 24 during rotation of drill bit 20. The respective longitudinal length of cutting elements 146, 152 and 156 as measured from base portion 102 is preferably varied. As a result of varying or staggering the longitudinal length of cutting elements 146, 152 and 156, the area of contact between respective first rows 111, 121 and 131 with the bottom of borehole 24 will also vary. The circumferential spacing between respective cutting elements 146, 152 and 156 is also varied to further provide for overlapping contact with the bottom of borehole 24.

As a result of forming first rows 111, 121 and 131 in accordance with teachings of the present invention the total surface area of engagement with bottom hole 24 is increased which increases the dynamic stability of the associated rotary cone drill bit 20. Also, the increased area of contact between the cutting elements of first rows 111, 121 and 131 also results in reduced wear of the associated cutting elements. As discussed later in more detail, these benefits are obtained without reducing the downhole drilling action associated with machined cutting structures 110, 120 and 130.

Respective second rows 112, 122 and 132 of machined cutting structures 110, 120 and 130 are formed at slightly different longitudinal distances from respective noses 106 of cutter cone assembly 100*a*, 100*b* and 100*c*. By varying the longitudinal distance from respective nose 106, first cutting structure 110 includes first trough or groove 116 formed between first row 111 and second row 112. First machined cutting structure 110 also includes second trough or groove 118 formed between second row 112 and third row 113. Second machine cutting structure 120 includes a corresponding first trough or groove 126 formed between first row 121 and second row 122. Third machined cutting structure 130 includes first trough or groove 136 formed between first row 131 and second row 132. Selecting the desired dimensions, configuration and orientation of the associated cutting elements 148 and the distance from respective nose 106, second row 112 of first cutting structure 110 will be received within corresponding first trough 126 of second machined cutting structure 120 and first trough 136 of third machined cutting structure 130. Properly selecting the distance from nose 106 allows cutting elements 146, 148, 150, 152, 154, 156 and 158 to be disposed between corresponding rows of adjacent cutter cone assemblies 100*a*, 100*b* and 100*c*.

Figures 4A, 4B, 4C, 5A, 5B, 5C:
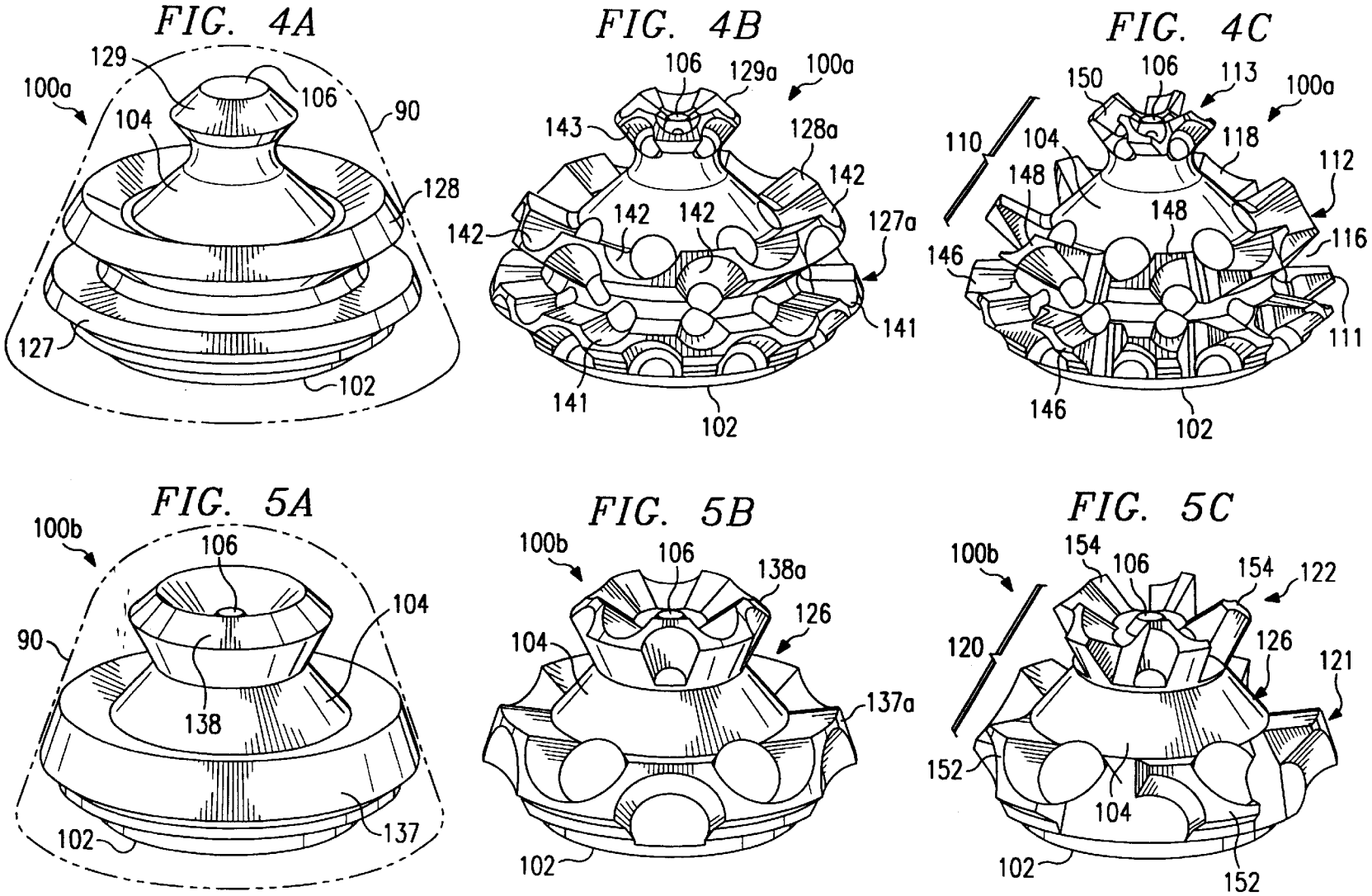
FIG. 4A is a schematic drawing showing an isometric view of an intermediate step while forming a cutter cone assembly with a first machined cutting structure from a generally cone shaped blank in accordance with teachings of the present invention.
FIG. 4B is a schematic drawing showing an isometric view of the cutter cone assembly of FIG. 4A during another intermediate step while forming the first machined cutting structure in accordance with teachings of the present invention.
FIG. 4C is a schematic drawing showing an isometric view of the cutter cone assembly of FIG. 4A having the first machined cutting structure formed thereon in accordance with teachings of the present invention.
FIG. 5A is a schematic drawing showing an isometric view of an intermediate step while forming a cutter cone assembly with a second machined cutting structure from a generally cone shaped blank in accordance with teachings of the present inventions.
FIG. 5B is a schematic drawing showing an isometric view of the cutter cone assembly of FIG. 5A during another intermediate step while forming the second machined cutting structure in accordance with teachings of the present invention.
FIG. 5C is a schematic drawing showing an isometric view of the cutter cone assembly FIG. 5A having the second machined cutting structure formed thereon in accordance with teachings of the present invention.
Figure 6C:
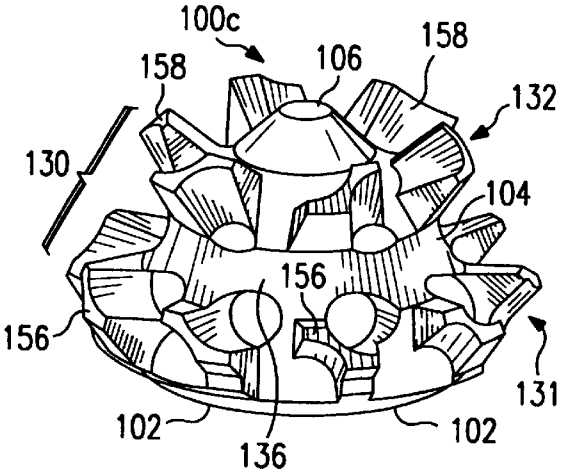
FIG. 6C is a schematic drawing showing an isometric view of the cutter cone assembly of FIG. 6A having the third machined cutting structure formed thereon in accordance with teachings of the present invention.
Figure 6B:
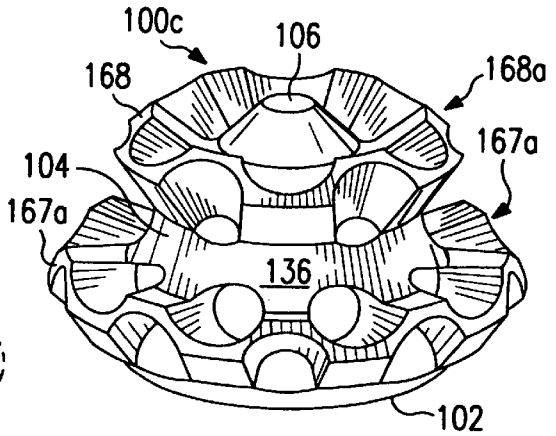
FIG. 6B is a schematic drawing showing an isometric view of the cutter cone assembly of FIG. 6A during another intermediate step while forming the third machined cutting structure in accordance with teachings of the present invention.
Figure 6A:
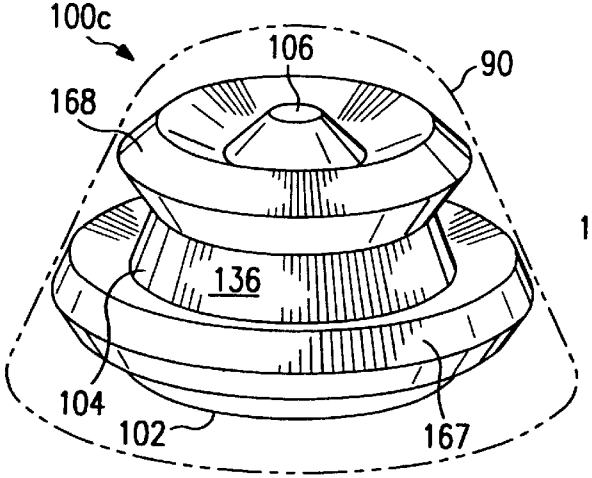
FIG. 6A is a schematic drawing showing an isometric view of an intermediate step while forming a cutter cone assembly with a third machined cutting structure from a generally cone shaped blank in accordance with teachings of the present invention.

Cone shaped blank 90 shown by dotted lines in FIGS. 4A, 5A and 6A preferably has a general configuration and exterior dimensions satisfactory for forming cutter cone assemblies 100*a*, 100*b* and 100*c* in accordance with teachings of the present invention. Blank 90 may be formed from various types of steel alloys and/or other metal alloys associated with rotary cone drill bits. Blank 90 may be formed from such materials using forging and/or casting techniques as desired.

FIGS. 4A, 4B and 4C show various steps associated with machining blank 90 in accordance with teachings of the present invention to fabricate machined cutting structure 110 on exterior surface 104 of cutter cone assembly 100*a*. For the embodiment shown in FIG. 4A, blank 90 is preferably placed in a lathe or similar metal working machine. A plurality of lathe turns or lathe cuts may then be used to form base portion 102 and nose 106 on blank 90. Lathe turns or lathe cuts may also be used to form tapered conical surface 104 with first concentric ring or land 127, second concentric ring or land 128 and third concentric ring or land 129 extending therefrom.

The location and dimensions of land 127 are selected to correspond with the desired location for first row 111 and the desired dimension and orientation of associated cutting elements 146. For example, the width of land 127 as measured from base 102 towards heights nose 106 is preferably selected to correspond with the desired longitudinal length of the associated cutting elements 146 as measured from base portion 102. The radial distance which land 127 extends from the associated exterior surface 104 is preferably selected to accommodate forming cutting elements 146 having a desired height as measured from the same exterior surface 104.

The location and dimensions of second land 128 and third land 129 are selected in a similar manner to correspond with the desired location for respective second row 112, third row 113 and size of their associated cutting elements 148 and 150. The longitudinal spacing between land 127 and 128 corresponds generally with first trough or groove 116. The longitudinal spacing between second land 128 and third land 129 corresponds generally with second trough or groove 118.

For the embodiment of the present invention as represented by FIG. 4B, another step in fabrication of machined cutting structure 110 on exterior surface 104 of cutter cone assembly 100*a* preferably includes a series of plunge cuts to form corrugations 141 in first land 127. For some application, the plunge cutting tool (not expressly shown) may have a diameter approximately twice the width of first land 127. First land 127 may now be described as a corrugated web and is designated 127*a*. Plunge cutting techniques are preferably used to form corresponding corrugations 142 in second land 128 and corrugations 143 in third land 129. In a similar manner, land 128 may be described as corrugated web 128*a* and third land 129 described as corrugated web 129*a*. A five axis milling machine may also be used to form corrugated webs 127*a*, 128*a* and 129*a*.

For some types of downhole formations a machined cutting structure such as shown in FIG. 4B may be satisfactory for use with some rotary cone drill bits. For other types of downhole formations it may be preferable to interrupt or cut corrugated webs 127*a*, 128*a* and 129*a* to form respective cutting elements 146, 148 and 150. For the embodiment of the present invention shown in FIG. 4C, corrugated webs 127*a*, 128*a* and 129*a* have been longitudinally cut to form rows 111, 112 and 113 of respective cutting elements 146, 148 and 150. Various milling techniques may be used to cut corrupted webs 127*a*, 128*a* and 129*a*.

For this embodiment, cutting elements 146, 148 and 150 have approximately the same general configuration. However, the dimensions and orientation associated with cutting elements 146, 148 and 150 will vary depending upon the dimensions associated with respective lands 127, 128 and 129 and respective machining techniques used to form cutting elements 146, 148 and 150.

FIGS. 5A, 5B and 5C show various steps associated with machining blank 90 in accordance with teachings of the present invention to fabricate machined cutting structure 120 on exterior surface 104 of cutter cone assembly 100*b*. FIGS. 6A, 6B and 6C show various steps associated with machining blank 90 in accordance with teachings of the present invention to fabricate machined cutting structure 130 on exterior surface 104 of cutter cone assembly 100*c*. Machined cutting structures 120 and 130 may be formed with lathe turns and plunge cuts in substantially the same manner as previously described with respect to forming machined cutting structure 110 in FIGS. 5A, 5B and 5C.

FIG. 5A shows first concentric ring or land 137 and second concentric ring or land 138 formed thereon and extending radially from exterior surface 104. FIG. 6A shows first concentric ring or land 167 and second concentric ring or land 168 formed on and extending radially from the respective exterior surface 104. The location and dimensions of first lands 137 and 167 are selected to correspond with the desired location for respective first rows 121 and 131 and size of respective cutting elements 152 and 156. The location and dimensions of respective second concentric lands 138 and 168 are selected in a similar manner to correspond with the desired location for respective second rows 122 and 132 and size of their associated cutting elements 154 and 158.

Plunge cutting techniques as previously described with respect to corrugations 141, 142 and 143 as shown in FIG. 4B may be satisfactorily used to form corrugated webs 137*a* and 138*a* on the exterior of cutter cone assembly 100*b* and corrugated webs 167*a* and 168*a* on the exterior of cutter cone assembly 100*c*. For the embodiment of the present invention as shown in FIGS. 4B, 5B and 6B corrugated webs 127*a*, 128*a*, 129*a*, 137*a*, 138*a*, 167*a* and 168*a* have a generally sinusoidal configuration. For other applications, corrugated webs with other types of symmetrical and/or asymmetrical configurations may be formed on the exterior of an associated cutter cone assembly. For the embodiment of the present invention as shown in FIGS. 4C, 5C and 6C, the respective cutting elements in each row 111, 112, 113, 121, 122, 131 and 132 have approximately the same size, configuration and orientation. However, for other applications the present invention would allow cutting elements in each row to vary in size and/or location with respect to other cutting elements in the same row. Also, the orientation of cutting elements within each row may also be varied. For example, varying the diameter of the machine tool used to form the various plunge cuts will result in modifying the dimensions of the resulting cutting element. Also, varying the size of the milling tool used to make each cut in corrugated webs 127*a*, 128*a*, 129*a*, 137*a*, 138*a*, 167*a* and 168*a* will vary the dimensions the resulting cutting elements.

Figure 7:
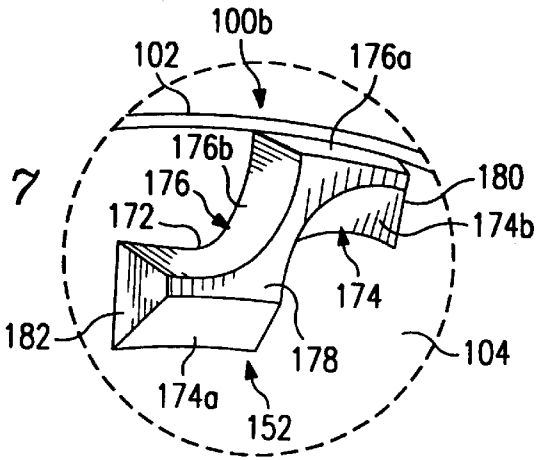
FIG. 7 is a schematic drawing showing an enlarged, isometric view of a cutting element associated with the rotary cone drill bit of FIG. 3.

FIG. 7 is an enlarged drawing showing a typical cutting element 152 in first row 121 of cutter cone assembly 100*b*. Cutting element 152 includes base 172, interior surface 174, exterior surface 176, crest 178, leading surface 180 and trailing surface 182. Exterior surface 176 represents the portion of cutting element 152 located adjacent to wall 28 of borehole 24. Leading surface 180 represents the first portion of cutting element 152 that initially contacts the downhole formation at the bottom of borehole 24. Crest 178 is a generally planar surface with an ess shape or ogee shaped configuration.

For the embodiment of the present invention as shown in FIGS. 4C, 5C and 6C machine cutting structures 110, 120 and 130 preferably contain cutting elements with an ogee shaped configuration similar to crest 178 of cutting element 152. As a result contact between cutter cone assemblies 100*a*, 100*b* and 100*c* with the bottom of borehole 24 generates a significantly different pattern with improved drilling action as compared to previous rotary cone drill bits.

Interior surface 174 includes first surface 174*a* and second surface 174*b*. Exterior surface 176 also includes first surface 176*a* and second surface 176*b*. The configuration of portions 174*a* and 176*a* are largely dependent upon the configuration of the corresponding surfaces of first land 137. Surfaces 174*b* and 176*b* are largely determined by the type and size of the plunge cutting tool used to form corrugated web 137*a*. Surfaces 174*b* and 176*b* cooperate with each other and crest 178 to generate what may be described as plowing action or cross cut action as cutting element 152 engages the bottom of borehole 24. Surfaces 174*a* and 176*a* cooperate with each other to generate what may be described as a generally slicing action as cutting element 152 contacts the bottom and side of borehole 24. As a result of forming machine cutting structures 110, 120 and 130 with a plurality of cutting elements having the previously described downhole drilling action, the requirement to offset cutter cone assemblies 100*a*, 100*b* and 100*c* is substantially reduced or eliminated.

The configuration of leading surface 180 and trailing surface 182 are largely dependent on the type of milling tool used to cut corrugated web 137*a* into individual cutting elements 152. The respective angles formed between exterior surface 104 and surfaces 174, 176, 180 and 182 may be relatively steep. For example, depending upon the type of plunge cutting tool used to form corrugated web 137*a*, the resulting surfaces 174*b* and 176*b* may extend approximately normal from exterior surface 104. Depending upon the type of lathe cutting tool and milling tool used to form cutting element 152, surfaces 174*a*, 176*a*, 180 and 182 may extend from exterior surface 104 at an angle of approximately one hundred and ten degrees (110°).

As a result of forming relatively steep surfaces 174, 176, 180 and 182 extending from exterior surface 104, the area of contact between cutting element 152 and the bottom of borehole 24 represented by crest 178 will remain relatively constant despite substantial wear of cutting element 152. In a similar manner the contact between surfaces 174, 176, 180 and 182 with the bottom of borehole 24 will also remain relatively constant. Therefore, the associated machine cutting structure 120 will remain relatively sharp and provide the desired downhole drilling action despite wear of individual cutting elements 152 and 154.

The total area of contact between base 172 and exterior surface 104 is generally larger than the area of contact associated with a conventional milled tooth having approximately the same height and width. As a result, cutting element 152 has sufficient strength required for the aggressive cutting profile associated with surfaces 174, 176, 180 and 182 and crest 178.

The service life of machined cutting structures 110, 120 and 130 may be improved by the addition of materials such as tungsten carbide or other suitable materials to selected wear areas. The addition of material to selected wear areas of machined cutting structures 100, 120 and 130 is known as "hardfacing." Conventional methods of applying hardfacing include, for example, in welding torch application techniques, setting a heat level of the welding torch to accommodate the thickest mass of each cutting element.

Although the present invention and its advantages have been described in detail, it should be understood that various changes, substitutions, and alterations can be made therein without departing from the spirit and scope of the present invention as defined by the appended claims.

What is claimed is:

1. A method for manufacturing a rotary cone drill bit having at least one support arm with a cutter cone assembly rotatably mounted thereof comprising the steps of:

a) forming a base portion on a cone shaped blank;

b) forming a nose on the cone shaped blank;

c) forming a generally tapered, conical surface extending from the base portion to the nose;

d) forming at least one concentric land extending circmferentially around the tapered, conical surface and extending radially therefrom;

e) forming a plurality of corrugations in the land; and f) cutting the corrugated land to form respective cutting elements.

2. The method of claim 1, said step d) comprising: forming at least two concentric lands extending circumferentially around the tapered, conical surface and extending radially therefrom; and forming corrugation having a generally sinusoidal configuration in each land.

3. The method of claim 1, said step d) comprising: forming at least three concentric lands extending circumferentially around the tapered, conical surface and extending radially therefrom; and forming corrugations in each land.

4. The method of claim 1 further comprising forming the generally tapered, conical surface and the concentric land by a series of lathe turns.

5. The method of claim 1 further comprising forming the corrugations in the land by a series of plunge cuts.

6. The method of claim 1 further comprising applying a layer of hardfacing material to selected portions of each cutting element.

7. A method for fabricating a machined cutting structure on a cone shaped blank associated with a cutter cone assembly of a rotary cone drill bit comprising the steps of:

a) forming a base portion on the blank;

b) forming a nose on the blank opposite from the base portion;

c) forming a generally tapered, conical surface on the exterior of the blank extending from the base portion to the nose;

d) forming at least one concentric ring extending circumferentially around the tapered conical surface and extending radially therefrom; and e) forming a plurality of corrugations in the ring to provide a corrugated web.

8. The method of claim 7 further comprising forming the generally tapered, conical surface and the concentric ring by a series of lathe turns.

9. The method of claim 7 further comprising forming the corrugated web of a series of plunge cuts at selected locations in the concentric ring.

10. The method of claim 7 further comprising cutting the corrugated web into multiple segments to form a plurality of cutting elements.

11. The method of claim 10 further comprising a series of mill cuts to form the respective cutting elements.

12. The method of claim 10 further comprising applying a layer of hardfacing material to selected portions of each cutting element.

13. The method of claim 7, said step d) comprising: forming a first concentric ring adjacent to the base portion and extending circumferentially around the generally tapered, conical surface; and forming a second concentric ring extending circumferentially around the generally tapered, conical surface at a location intermediate the base portion and the nose.

14. The method of claim 7, said step d) comprising:

forming a first concentric ring adjacent to the base portion extending circumferentially around the generally tapered, conical surface;

forming a second concentric ring extending circumferentially around the generally tapered, conical surface at a location intermediate the base portion and the nose; and forming a third concentric ring extending circumferentially around the generally tapered, conical surface adjacent to the nose.

* * * * *